US006931990B2

(12) United States Patent
Wei

(10) Patent No.: US 6,931,990 B2
(45) Date of Patent: Aug. 23, 2005

(54) STAMPER

(75) Inventor: Chen Hui Wei, Ningbo (CN)

(73) Assignee: Sun Coast Merchandise Corp., Commerce, CA (US)

( * ) Notice: Subject to any disclaimer, the term of this patent is extended or adjusted under 35 U.S.C. 154(b) by 0 days.

(21) Appl. No.: 10/672,162

(22) Filed: Sep. 26, 2003

(65) Prior Publication Data

US 2005/0066828 A1 Mar. 31, 2005

(51) Int. Cl.[7] ..... B41K 1/42
(52) U.S. Cl. ..... 101/333; 101/334; 101/351.3; 101/351.2; 101/104
(58) Field of Search ..... 101/334, 333, 101/351.3, 351.2, 104

(56) References Cited

U.S. PATENT DOCUMENTS

| | | | | | |
|---|---|---|---|---|---|
| 288,385 | A | | 11/1883 | Van Zandt | |
| 315,286 | A | | 4/1885 | Hill | |
| 3,783,786 | A | * | 1/1974 | Ellison et al. | 101/333 |
| 4,181,560 | A | * | 1/1980 | Maitland | 156/542 |
| 4,362,101 | A | * | 12/1982 | Ahrens | 101/327 |
| 4,432,281 | A | * | 2/1984 | Wall et al. | 101/334 |
| 4,579,057 | A | * | 4/1986 | Hewitt et al. | 101/368 |
| 4,823,691 | A | * | 4/1989 | Muller | 101/104 |
| 4,823,696 | A | | 4/1989 | Skopek | |
| 4,841,860 | A | | 6/1989 | Fehling | |
| 4,852,489 | A | | 8/1989 | Wall | |
| 4,970,954 | A | | 11/1990 | Weir | |
| 5,058,501 | A | | 10/1991 | Skopek | |
| 5,152,223 | A | | 10/1992 | Mairon | |
| 5,222,431 | A | * | 6/1993 | Kawahara | 101/128.21 |
| 5,359,932 | A | | 11/1994 | Van Breene | |
| 5,517,916 | A | | 5/1996 | Dour | |
| 5,623,875 | A | | 4/1997 | Perets | |
| 5,649,485 | A | | 7/1997 | Dour | |
| 5,671,668 | A | | 9/1997 | Shih | |
| 5,709,145 | A | | 1/1998 | Shih | |
| 5,727,467 | A | | 3/1998 | Skopek | |
| 5,743,186 | A | | 4/1998 | Liao | |
| 5,768,992 | A | | 6/1998 | Daw | |
| 5,809,886 | A | * | 9/1998 | Faber | 101/334 |
| 6,499,398 | B2 | | 12/2002 | MacNeil | |

FOREIGN PATENT DOCUMENTS

| | | | | |
|---|---|---|---|---|
| JP | 2000-270208 | * | 0/2001 | B41K 1/02 |

* cited by examiner

*Primary Examiner*—Andrew H. Hirshfeld
*Assistant Examiner*—Andrea H. Evans
(74) *Attorney, Agent, or Firm*—Brian Carpenter

(57) ABSTRACT

A stamper with a metal plate positioned between a platen and a stamp die is disclosed. The metal plate results in an improved imprint by providing better support to the stamp die. The stamper further comprises a removable ink pad and a rotatably reversible platen with cam mechanism. The metal platen plate with it's adjoining stamp die face downwards when the stamper is in an imprint position and the metal platen plate with it's adjoining stamp die face upwards when the stamper is in a re-inking position.

8 Claims, 5 Drawing Sheets

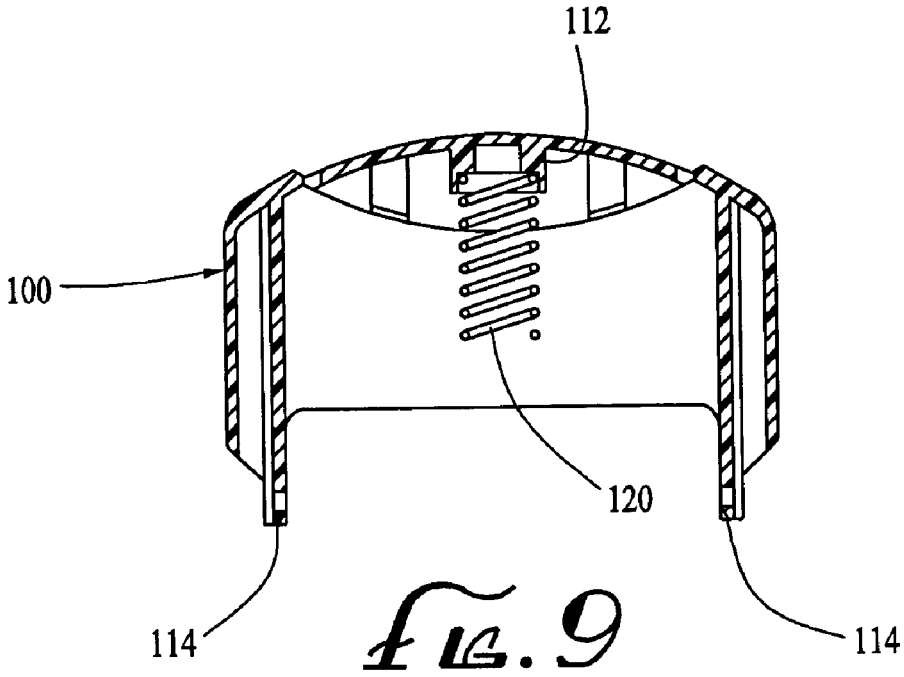
FIG. 9
FIG. 10
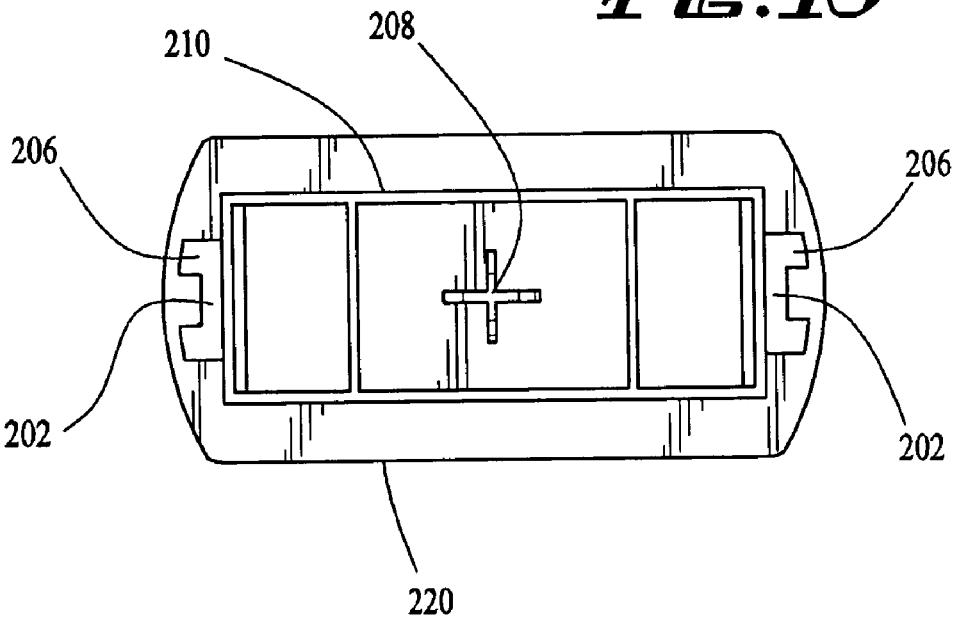

STAMPER

BACKGROUND OF THE INVENTION

1. Field of the Invention

The present invention relates to self inking stampers with rotating reversing platens. More specifically, the present invention relates to a stamper with a metal plate positioned between the rotating platen and stamp die, providing support to the stamp die.

2. Description of the Prior Art

Self-inking hand stampers are well known in the prior art. The first self inking stampers were made almost entirely of metal. A self-inking hand stamper in which the die plate reversed its position at every stroke, so as to turn face up to take ink in its rest position and then to turn face down to make an impression, was disclosed in 1885 U.S. Pat. No. 315,286 to Hill. The various types of self-inking hand stampers are well discussed in U.S. Pat. No. 5,359,932 to Van Breene. Later, in U.S. Pat. No. 5,517,916 a self inking stamper with a removable ink pad was disclosed. Dour, in U.S. Pat. No. 5,649,485 discloses a self inking stamper with improved accessibility to a removable ink pad.

The prior art has sought to make self-inking stampers less expensive, smaller in size, and easier to assemble, as shown by U.S. Pat. No. 5,152,223 to Mairon. Modern day stampers are usually made of plastic in order to be cost effective and commercially viable. A stamper made almost entirely of metal would be too costly to manufacture and market commercially. Therefore, self inking metal stampers have essentially disappeared from the marketplace. This evolution in the self-inking stamper, from metal to plastic, has however resulted in stamping devices today that are less durable and quite often do not leave a quality impression. For example, especially in large stampers, the middle section of the stamp die does not get sufficient support from the middle of the plastic platen. Therefore, for example, the far left and far right portions of the imprint are clear, while the middle portion of the imprint is faint or smudged. There are times when a very clear imprint is crucial, for example, when stamping a drug dosage on a drug prescription form. In fact, a clear imprint is always desirable. What is needed is a device that is inexpensive to produce and yet gives an excellent quality of imprint.

SUMMARY OF THE INVENTION

It is an object of the present invention to provide a self inking stamper that can be inexpensively produced.

Another object of the present invention is to provide a self-inking stamper that leaves uniform and consistently excellent quality imprints. Such a stamper would be useful in clearly imprinting small letters, for example, drug prescription information.

Yet another object of the present invention is to provide a self-inking stamper that is durable.

Still another object of this invention is to provide for a self-inking stamper that has an improved reversing cam mechanism.

The objects of this invention are accomplished by providing a metal plate between the body of a reversing platen and a rubber stamp die. The metal plate supports the stamp die, resulting in a much improved imprint. However, since the entire stamper does not need to be constructed of metal, the stamper can be manufactured at a commercially advantages cost.

The advantage of this invention is that the metal plate, attached to the platen, provides excellent resilience and support to the stamp die. Thus, while still producing a stamper that is inexpensive to manufacture, the quality of the imprint produced by this stamper is comparable to a stamper made completely of metal parts. Furthermore, the motion of the upper housing upon the lower housing is especially smooth because of the design of the stamper of the present invention. Finally, this stamper is easily and inexpensively assembled from relatively few parts.

In accordance with the preferred embodiment of the present invention, the stamper comprises an upper housing and a lower housing with a spring biasing vertical sliding motion of the upper housing upon the outside of the lower housing. The preferred embodiment is comprised of a platen connected with a metal plate that supports a stamp die. The platen is rotated by a cam mechanism, from a re-inking position to an imprinting position as the upper housing is slidably pushed down upon the lower housing. As pressure upon the spring is relieved, the upper housing slidably moves upwards, away from the lower housing, and the platen is returned to the re-inking position. The support of the stamp die by the metal plate results in a vastly improved imprint compared to self inking stampers disclosed in the prior art.

In accordance with at least one embodiment of the present invention, the stamper comprises a removable roof, which if transparent enables the display of an advertising insert, or label identifying the stamper text, placed between the upper housing and the roof. The roof in at least one embodiment may be electively removed and replaced at will in order to exchange inserts. Alternatively, advertising may be directly imprinted on the roof or upper housing. Advertising can also be imprinted on the side surfaces of the outer upper housing. It can be seen that although inexpensive, this stamper is highly adaptable because of the ability to remove and exchange ink pads for those of other colored ink, the ability to change inserts under the roof, and even the ability to switch stamp dies when a removable adhesive is used.

The stamper of the present invention is comprised of an upper housing, slidably biased over a lower housing by a spring; said upper housing including parallel vertical rails, that traverse between platen tracks formed by combining an inner section and an outer section of said lower housing; an ink pad located within said lower housing; a reversible platen rotatably engaging a platen track within the inner section of said lower housing, said reversible platen comprising a platen body including a cam; a first side of a rigid metal plate connected with said platen body; and a stamp die connected with the opposite side of said metal plate; wherein said metal platen plate with it's adjoining stamp die face downwards when the stamper is in an imprint position and said metal platen plate with it's adjoining stamp die face upwards when the stamper is in a re-inking position.

Still other objects and advantages of the present invention will become readily apparent to those skilled in the art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

The foregoing objects, features, advantages and preferred embodiments of the stamper of the present invention will be better understood from the following detailed description taken in conjunction with the accompanying drawings in which:

FIG. 9 is a front cross sectional view of the upper housing and spring of the present invention;

FIG. 10 is a top plan view of the assembled lower housing of the stamper of the present invention.

DETAILED DESCRIPTION

This application claims priority under 35 U.S.C. 119 from Chinese (PRC) Application Number 02260530.4 titled TURNOVER STAMPER which was filed on Sep. 28, 2002.

The accompanying Figures depict embodiments of the present invention, and features and components thereof. With regard to means for fastening, mounting, attaching or connecting the components of the present invention to form the apparatus as a whole, unless specifically described otherwise, such means are intended to encompass at least conventional fasteners such as machine screws, machine threads, snap rings, hose clamps such as screw clamps and the like, rivets, nuts and bolts, toggles, pins and the like. Components may also be connected by friction fitting, snap fitting, adhesives, or by welding or deformation, if appropriate. Unless specifically otherwise disclosed or taught, materials for making components of the present invention are selected from appropriate materials such as metal, metallic alloys, natural or synthetic fibers, plastics and the like, and appropriate manufacturing or production methods including casting, extruding, molding and machining may be used.

Any references to front and back, right and left, top and bottom, upper and lower, medial and lateral, and horizontal and vertical are intended for convenience of description, not to limit the present invention or its components to any one positional or spacial orientation.

Figure 2:
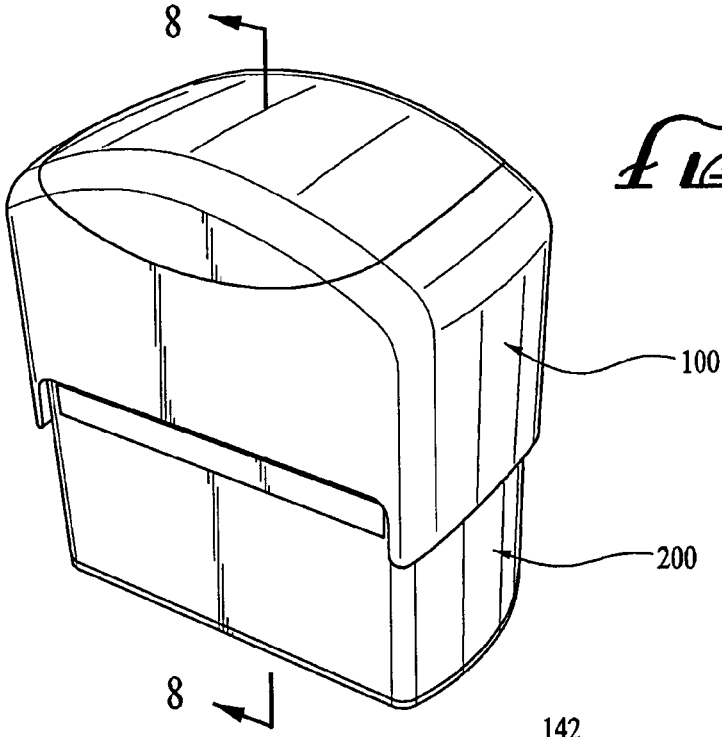
FIG. 2 is a front perspective view of an assembled self inking stamper in accordance with the present invention.

Referring more specifically to the drawings, as illustrated, in FIG. 2, the self inking stamper of the present invention is comprised of an upper housing 100, and a lower housing 200.

Figure 1:
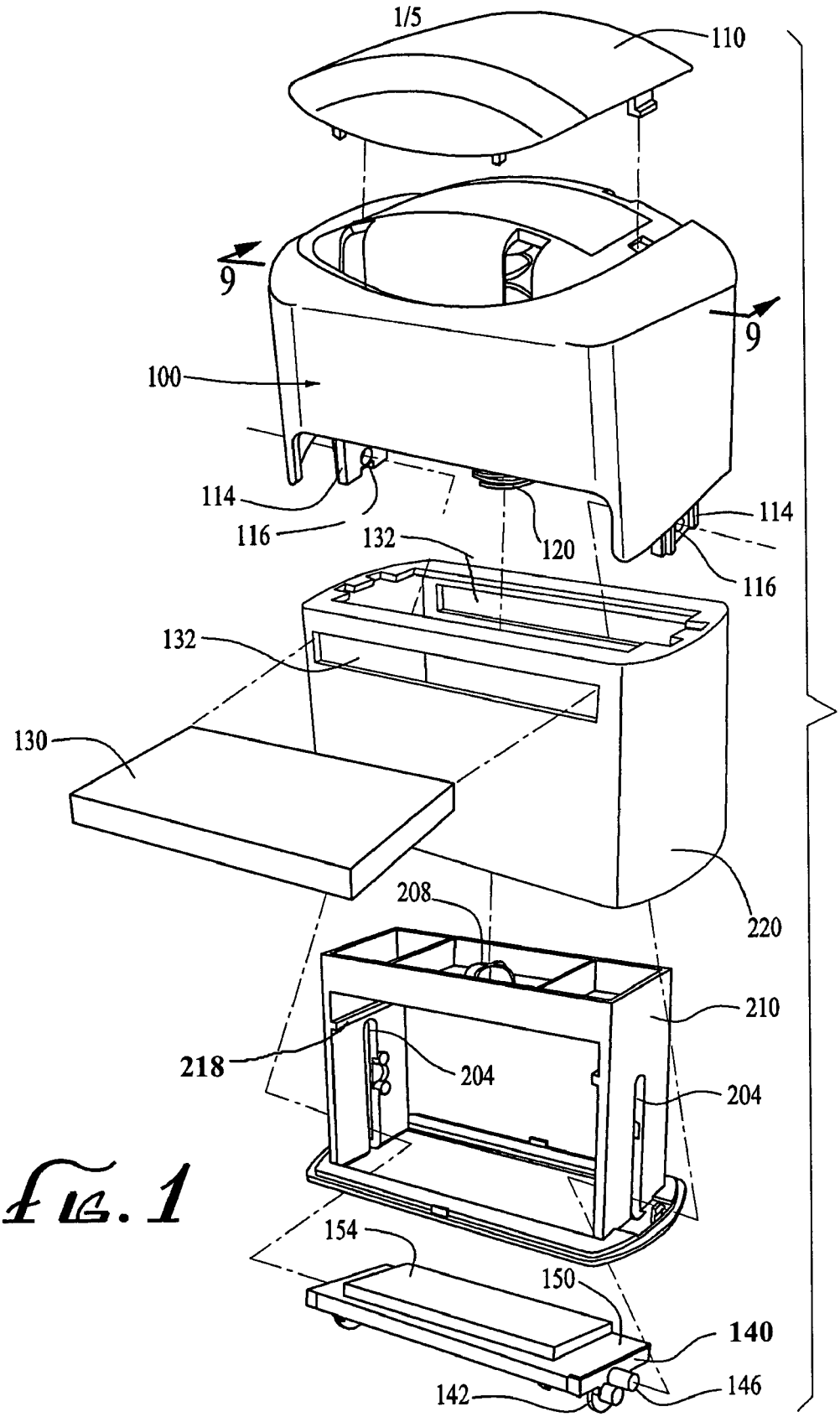
FIG. 1 is a front perspective, exploded, view of the stamper of the present invention.

Referring additionally to FIG. 1, the lower housing 100 is comprised of an inner section 210 and an outer section 220, said inner section 210 snap fitting inside said outer section 220. There is also a removable ink pad 130, and a reversible platen 140. The upper housing 100 comprises an outside, and an inside with two sets of parallel vertical rails 114. Furthermore, there are platen tracks 204 on the left and a right sides of the inner section 210 of the lower housing 200. Each platen track 204 is an essentially long thin vertical opening that guides the platen 140 in a vertical up and down motion by engaging a platen guide pin.

In at least one embodiment of the present invention, there is a removable roof 110 that snap fits onto the top of the upper housing 100. The removable roof 110 may be transparent and an advertising insert or other indicia, for example stamper text, may be placed between the removable roof 110 and the top of the upper housing 100. Alternatively, the indicia may be directly imprinted on top of the removable roof 110 or on a side of the upper housing 100.

Figure 7:
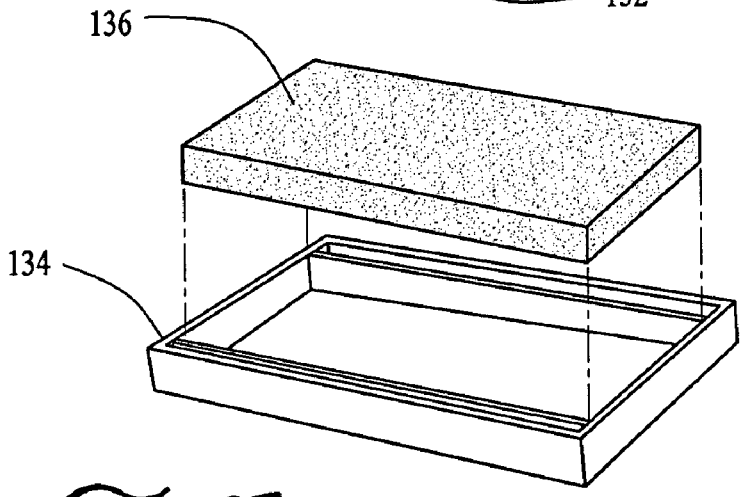
FIG. 7 is a perspective, exploded, view of the ink pad of the stamper of the present invention.

There are horizontal ink pad access slots 132 in the front side and the rear side of said outer section 220 of the lower housing 200, located near the top of the lower housing 200. Said horizontal ink pad access slots 132 accept and engage a removable ink pad 130. The removable ink pad 130, as shown in more detail in FIG. 7, comprises an ink pad carrier 134 and an associated absorbent ink pad 136. There is also a slight shelf 218 in the lateral walls of the inner section 210 of the lower housing 200 that helps further support the removable ink pad 130. The ink pad 130 can slide into and out of the lower housing 200 without having to disassemble any other parts of the stamper. The removable ink pad 130, although held securely by the horizontal ink pad access slots 132 and the shelves 218, may be easily removed for re-inking or for exchange with an ink pad of alternative colored ink.

Figure 3:
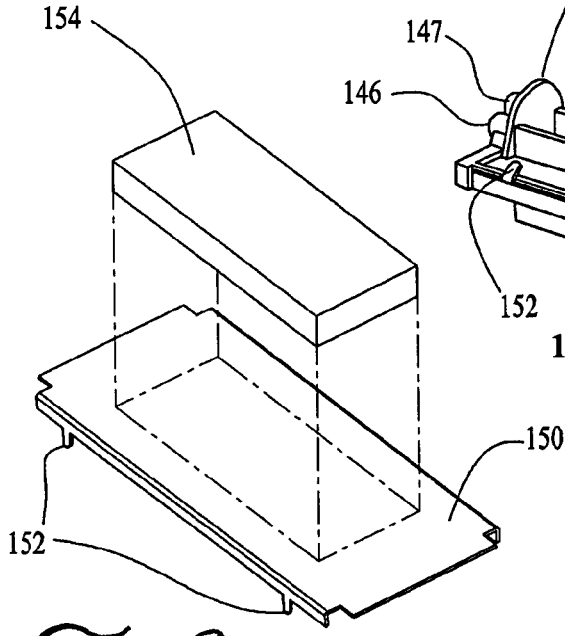
FIG. 3 is a perspective, exploded, view of the metal plate and stamp die of the stamper of the present invention.
Figure 4:
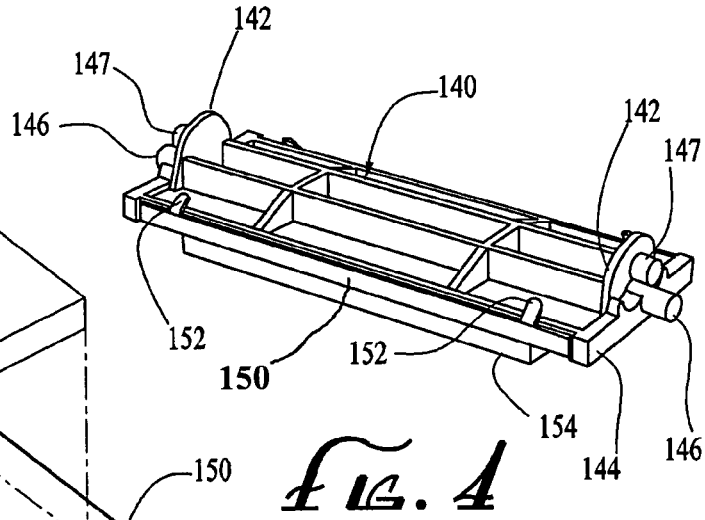
FIG. 4 is a perspective view of the platen, metal plate, and stamp die of the stamper of the present invention after those components are connected.

Also referring now to FIG. 3 and FIG. 4, a reversibly rotating platen 140 comprises a platen body 144, with a platen guide pin 146 and a cam 142 on each side thereof. The platen guide pins 146 move up and down vertically, guided within the platen tracks 204 of the lower housing 200, and engaging a hole 116 in the distal end of each corresponding parallel vertical rail 114. Connected to a first side of the platen body 144 by plate clips 152 is a metal platen plate 150. The metal platen plate 150 is comprised of a metal or metal alloy of sufficient rigidity to prevent the metal platen plate from deforming in the process of making imprints with the stamper. One skilled in the art would readily recognize appropriate metal compounds and appropriate thicknesses for the metal platen plate 150 to render it rigid. On the first side of the metal plate 150, is connected the platen. On the opposite side of the metal plate 150, is connected a stamp die 154. In the preferred embodiment, an adhesive secures the stamp die to the metal platen plate 150. In some embodiments, the adhesive may be of a type that allows the stamp die 154 to be removed and replaced, at will, with other various stamp dies. In this manner, one stamper may be utilized to make various imprints. An example of such an adhesive would be a two sided adhesive tape well known in the art.

Referring now to FIG. 8A–E, the spring 120 is positioned between the inside of the upper housing 100 and the outside of the lower housing 200. Located at the inside top of the upper housing 100 is an upper spring retainer 112 that firmly holds the top of the spring 120 in position in relation to the upper housing 100. The lower spring retainer 208 firmly holds the bottom of the spring 120 in position in relation to the lower housing 200. The spring 120 acts to bias the upper housing 100 upward and away from the lower housing 200.

Figures 8A, 8B, 8C, 8D, 8E:
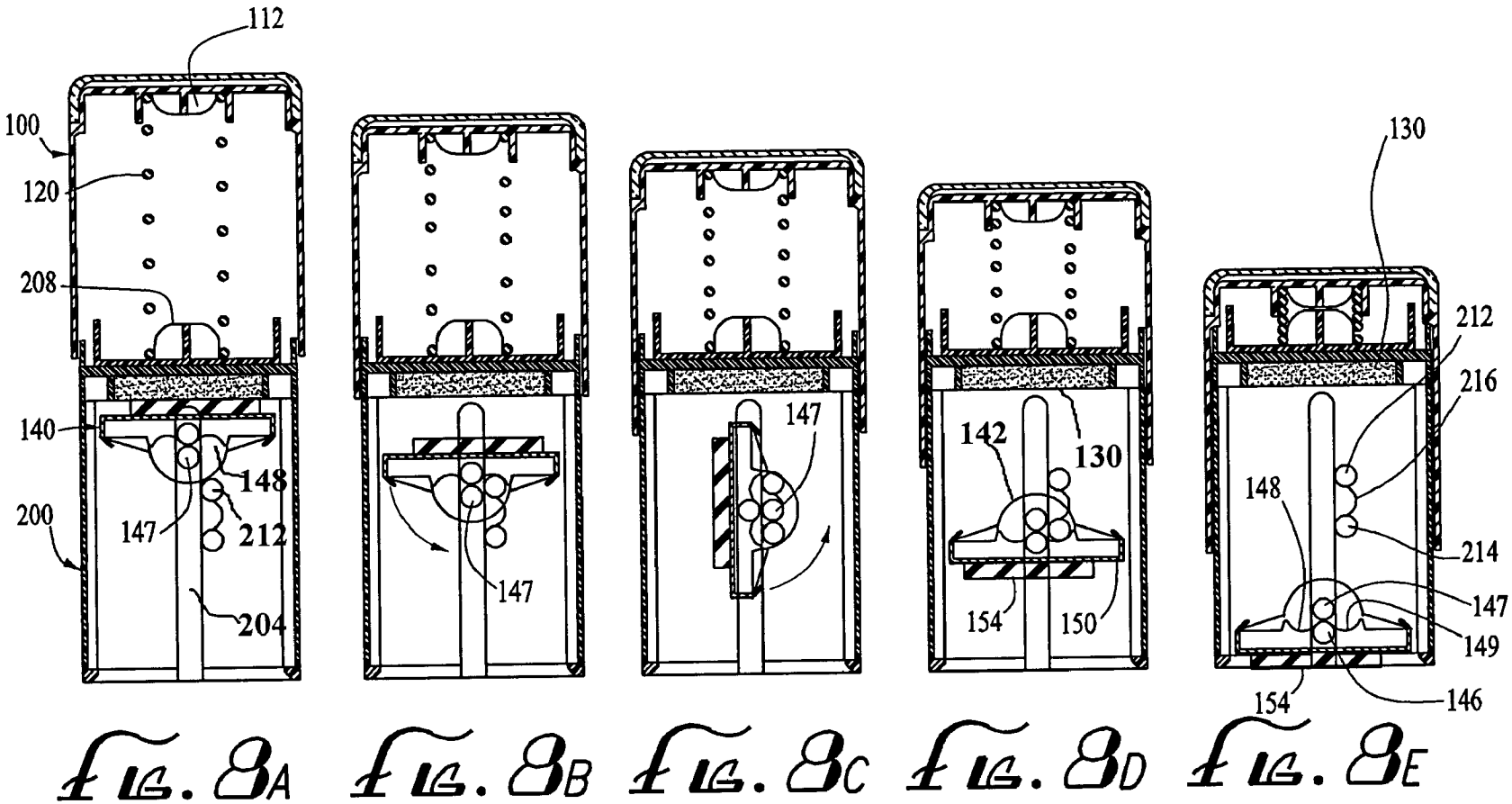
FIGS. 8*a–e* are side cross sectional views of the stamper of the present invention showing the intermediate positions of the platen between it's resting upper re-inking position and it's lower imprinting position.

The inner section 210 of the lower housing 200 further comprises a set of first housing pegs 212 and second housing pegs 214. Each set of housing pegs is in proximity to one of the platen tracks 204 which are respectively located on the left and right inside wall of the inner section 210 of the lower housing 200. As seen in FIG. 8E, the first housing peg 212 is located above the second housing peg 214, with a housing indentation 216 between said housing pegs to rotatably guide a platen cam 142 in a manner to be described in more detail below. The cam 142 further comprises an axially aligned cam peg 147, and a first cam indentation 148 and a second cam indentation 149, respectively, on either side of the cam peg 147. The cam indentations are curvilinear and slightly larger in diameter than the first housing peg 212 and second housing peg 214.

The metal platen plate 150 with it's associated stamp die 154 face downwards when the stamper is in imprint position. The metal platen plate 150 with it's associated stamp die 154 face upwards, towards the ink pad 130 when the stamper is in re-inking position.

Referring now to FIG. 9, the upper housing further comprises an upper spring retainer 112 which secures a spring 120. Extending from the inside of the upper housing 100 are two sets of parallel vertical rails 114. The parallel vertical rails 114 slidably guide the upper housing 100 over the lower housing 200, as said upper housing 100 moves over the lower housing 200 in an up and down vertical traveling motion.

Figure 5:
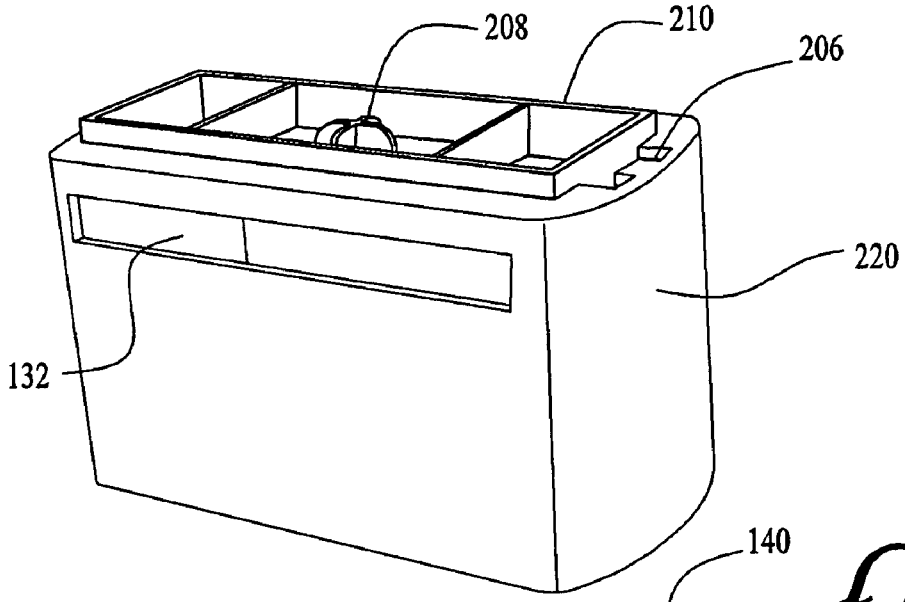
FIG. 5 is a front perspective view of the assembled lower housing of the stamper of the present invention.
Figure 6:
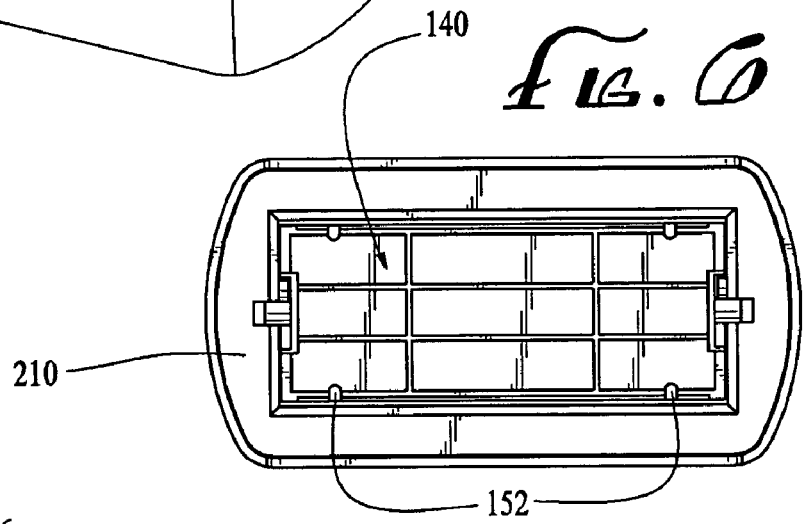
FIG. 6 is a bottom view of the stamper of the present invention with the platen in it's re-inking position.

Referring to FIG. 5 and FIG. 10, once the inner section 210 and the outer section 220 are assembled, there is formed a left and a right rail guide 202. The parallel vertical rails 114 engage the rail guides 202. Rail tracks 206, which also are formed by the combination of the inner section 210 and the outer section 220, help to further securely engage the parallel vertical rails 114 as they travel within the lower housing 200. The rail guides 202, with their corresponding rail tracks 206, are essentially "C" shaped openings on the top of the lower housing 200.

Referring once again to FIGS. 8A–E, the rotation and movement of the platen 140 is shown in detail. The platen 140 in it's resting position has the stamp die 154 and metal plate 150 facing upwards against the ink pad 130. The movement of the platen 140 from the top of the lower housing 200 to the bottom of the lower housing 200 starts when a force is applied to the top of the upper housing 100. The force compresses the spring 120 and slides the upper housing 100 vertically downward over the lower housing 200.

The platen guide pins 146 slide downward in the platen tracks 204, engaged by a hole in the distal end of each of the corresponding parallel vertical rails 114. Said parallel vertical rails move downward with the movement of the upper housing 100. As the platen 140 moves downwardly, the first cam indentation 148 engages the first housing peg 212, thus starting a rotation of the platen 140. The rotation completes 180 degrees as the cam peg 147 swings to engage the housing indentation 216, and the second cam indentation 149 engages the second housing peg 214. The platen 140 is thus rotated so that the metal plate and stamp die face downward, away from the ink pad 130 and towards a surface to be imprinted by the stamper. With further downward motion of the upper housing 100 upon the lower housing 200, the stamp die extends out past the bottom of the lower housing 200 to be available to create an imprint.

Upward movement of the platen 140 to starting position is propelled by the spring 120 which biases the upper housing 100 away from the top of the lower housing 200. As the platen 140 moves upward toward the ink pad, the second cam indentation 149 engages the second housing peg 214, beginning the rotation of the platen 140 back to it's original orientation. Then the cam peg 147 engages the housing indentation 216. Finally, the first cam indentation 148 engages the first lower housing peg 212. The platen 140 with the stamp die facing upward then comes to rest against the ink pad 130, thus resulting in re-inking of the stamp die 154.

The present invention further comprises a method of assembling a stamper comprising the steps of connecting the removable roof 110 to the top of the upper housing 100; connecting the spring 120 to the inside of the upper housing 100; connecting the inner section 210 of the lower housing 200 to the outer section 220 of the lower housing 200; connecting the removable ink pad 130 to the assembled lower housing 200; connecting the assembled lower housing 200 to the upper housing 100 and spring 120; connecting the platen 140 and connected metal plate 150 to holes 116 in the parallel vertical rails 114, by way of the platen guide pins 146; and inspecting the assembled stamper.

The present invention may be embodied in other specific forms without departing from the essential spirit or attributes thereof. It is desired that the embodiments described herein be considered in all respects as illustrative, not restrictive, and that reference be made to the appended claims for determining the scope of the invention.

What is claimed is:

1. A stamper comprising:

a. a non-metallic upper housing, slidably biased over a non-metallic lower housing by a spring;

b. said upper housing including parallel vertical rails, that traverse between platen tracks formed by combining an inner section and an outer section of said lower housing;

c. an ink pad located within said lower housing;

d. a single reversible platen rotatably engaging a pair of platen tracks within the inner section of said lower housing, said reversible platen comprising a platen body including a cam;

e. a first side of a rigid metal plate connected with said platen body; and;

f. a stamp die connected with the opposite side of said metal plate;

g. wherein said metal platen plate and the stamp die face downwards when the stamper is in an imprint position and said metal platen plate and the stamp die face upwards when the stamper is in a re-inking position.

2. A stamper as in claim 1, wherein said stamp die is removably connected with said metal plate by an adhesive.

3. A stamper as in claim 1, wherein said ink pad is a removable ink pad which may be slidably removable from the fully assembled stamper.

4. A stamper as in claim 1, wherein said cam comprises:

a. a cam peg between a first cam indentation and a second cam indentation;

b. wherein said cam rotatably engages a first lower housing peg and a second lower housing peg inducing said platen to rotate within said lower housing.

5. A stamper as in claim 1, further comprising:

a removable top cover snap fitted onto the top of said upper housing.

6. A stamper as in claim 5 wherein said removable top cover is transparent and wherein an advertising insert with various indicia may be placed between the removable top cover and the top of the upper housing.

7. A stamper comprising:

a. a non-metallic upper housing, slidably biased over a non-metallic lower housing by a spring;

b. an ink pad;

c. a single reversible platen rotatably engaging a pair of platen tracks within the inner section of said lower housing, said reversible platen comprising a platen body including a cam;

d. a first side of a rigid metal plate connected with said platen body;

e. a stamp die connected with the opposite side of said metal plate;

f. wherein said metal platen plate with its adjoining stamp die face downwards when the stamper is in an imprint position and said metal platen plate with its adjoining stamp die face upwards when the stamper is in a re-inking position.

8. A method of assembling a stamper comprising the steps of:

a. connecting a removable top cover to a top of a non-metallic upper housing;

b. connecting a spring to an inside of said upper housing;

c. connecting an inner section of a non-metallic lower housing to an outer section of said lower housing;

d. inserting a slidably removable ink pad into the lower housing;

e. connecting the lower housing to the upper housing and the spring; and f. connecting a single platen affixed to a rigid metal plate to holes in parallel vertical rails by way of paten guide pins.

* * * * *